US005947602A

United States Patent [19]

Coxsey

[11] Patent Number: 5,947,602

[45] Date of Patent: Sep. 7, 1999

[54] PORTABLE TRASH CARRYING DEVICE

[75] Inventor: Joe Bryant Coxsey, Poway, Calif.

[73] Assignee: Arcoa Industries, Inc., Escondido, Calif.

[21] Appl. No.: 08/934,586

[22] Filed: Sep. 22, 1997

[51] Int. Cl.[6] ..... B65D 33/02

[52] U.S. Cl. ..... 383/33; 383/12; 248/99

[58] Field of Search ..... 383/12, 33; 248/99; 220/9.2, 9.4

[56] References Cited

U.S. PATENT DOCUMENTS

| | | | |
|---|---|---|---|
| 2,785,724 | 3/1957 | Gold | 220/9.2 |
| 3,747,653 | 7/1973 | Ringer | 383/12 |
| 3,754,785 | 8/1973 | Anderson | 248/99 |
| 3,934,803 | 1/1976 | Paulus, Jr. | 383/33 X |
| 4,006,928 | 2/1977 | Beugin | 383/33 X |
| 5,180,126 | 1/1993 | Bennett | 248/99 |

FOREIGN PATENT DOCUMENTS

| | | | |
|---|---|---|---|
| 1289567 | 9/1972 | United Kingdom | 383/33 |

*Primary Examiner*—Jes F. Pascua
*Attorney, Agent, or Firm*—John J. Murphey

[57] ABSTRACT

A portable trash container comprising a handle having spaced-apart distal ends for carrying in one's hand at an angle to the ground where the rear distal end of the handle is carried above the front distal end; a closed loop depending from the handle; a support arm extending from and integral with the front distal end of the handle downward and rearwardly therefrom; and, a flexible bag comprising integral bag sides and an open bag top, the top peripherally mounted about the loop so that the bag extends rearward of the loop.

20 Claims, 2 Drawing Sheets

PORTABLE TRASH CARRYING DEVICE

BACKGROUND OF THE INVENTION

1. Field of the Invention

This invention pertains to the field of gardening implements. More particularly, it pertains to a unique trash carrying device for use in placing trash in a plastic trash bag for later disposal.

2. Description of the Prior Art

"Take out the trash", "Help your father clean the yard", and "Clean up this mess!" are statements heard by young people, boy friends, and spouses the world over. Something always has to be cleaned up and each of us has been chosen for the dirty work on numerous occasions.

Beginning with the discovery of plastic, plastic bags, and specifically plastic garbage or trash bags have been the tool of choice for these jobs. As widely advertised, garbage bags have tough walls to hold a large amount of trash, are thin-walled to remain light weight, and have closable open tops to secure the trash in the bag. The only features of plastic trash and garbage bags remaining are the problems associated with holding the top open when stuffing the trash into the bag and not ripping the bag walls while stuffing sharp objects, such as rose stems, hedge clippings and card board boxes into the bag.

We have all experienced the problem of holding open a limp plastic bag with one hand while trying to stuff the bag with branches, leaves, stems and the like with the other hand. The limpness in the bag causes it to collapse downward leaving only a vertical slit as the opening into the bag. To place trash and the like in this narrow opening, one must release their grip on the bag and use that hand to open the slit to stuff the trash in the bag. This makes the bag less than portable because it must be must be picked up and laid down at each instance of stuffing trash into it. In addition, because the walls of the bag are unsupported during this operation, the walls are often accidently slit when pushing sharp objects down into the bag.

The prior are has attempted to solve this problem by providing a loop having a circumferential length about the same as that of a plastic garbage or trash bag and providing means to temporarily attach the open top of the bag about the loop. The problem with this practice is that, when holding the loop in one's hand, and extending the user's arm downward, the bag drags on the ground. During this dragging, the bag comes into contact with sticks, stones and the like on the ground that catch on the plastic and cause slits, rips and rends in the bag bottom and walls. As soon as this occurs, the bag is no longer useful to hold trash and must be discarded.

In addition, this loop does nothing to support the walls of the bag while trash is being stuffed into the bag. This lack of support allows trash pushed up against the walls of the bag to cause rips in the walls and thus destroying the bag.

SUMMARY OF THE INVENTION

This invention is a device that is useful in gathering trash and the like for storage in containers awaiting disposal. It is also useful in holding the common plastic trash bag, such as a 33-gallon plastic trash bag, while it is being loaded with trash. The device is unique in that an arm extends down into the bag to maintain the bag above the ground during use. As a result, the bag remains open, so that it may be easily stuffed with trash, and also remains above the ground, so that it retains its size, shape and does not get torn during the time it is being used. Further, the invention allows for full support over the walls and bottom of the trash bag during use so that trash does not cut or rip the bag as it is being loaded with trash.

The invention is a portable trash carrying device comprising a closed loop, preferably flattened slightly on the bottom; a flexible bag comprising integral bag sides, a closed bottom and an open bag top, the top peripherally mounted about the loop so that the bag extends rearward of the loop; and, a bag support comprising a carrying handle and an arm extending rearward thereof and downward into the bag to hold the loop and bag above the ground when the device is carried by the handle. In one embodiment of the invention, the loop and handle may be collapsed to allow the device to be hung up for storage in a minimum space. While the bag attached to the loop may be used to carry trash from one location to another and to be emptied in another receptacle, the favored use of the device is to fully support a thin-walled plastic trash bag, such as a 33-gallon plastic trash bag, such that the trash bag can be stuffed with more trash than normal because the plastic walls of the bag are supported by the stronger bag that comes with the device.

Accordingly, the main object of this invention is a device to allow a plastic trash bag to be held above the ground, and the front of it held open so as to allow one to stuff the bag with trash, twigs, leaves, grass, and stems with one hand while holding the device and bag with the other hand. Other objects of the invention include a device that makes the use of plastic trash bags allowable without fear of having the bag torn or split during use, a device that allows a plastic trash bag to carry a larger load than otherwise because it is stuffed with trash while being backed with another, stronger surface; a device that allows one to hold the bag and stuff it with trash without having to lay the bag on the ground during the operation, and a device that will make the onerous task of cleaning up a yard or room less difficult and easier.

These and other objects of the invention may be determined by reading the description of the preferred embodiments along with the drawings attached hereto. The scope of protection sought by the inventor may be gleaned from a fair reading of the claims that conclude this specification.

DESCRIPTION OF THE PREFERRED EMBODIMENTS

Figure 1:
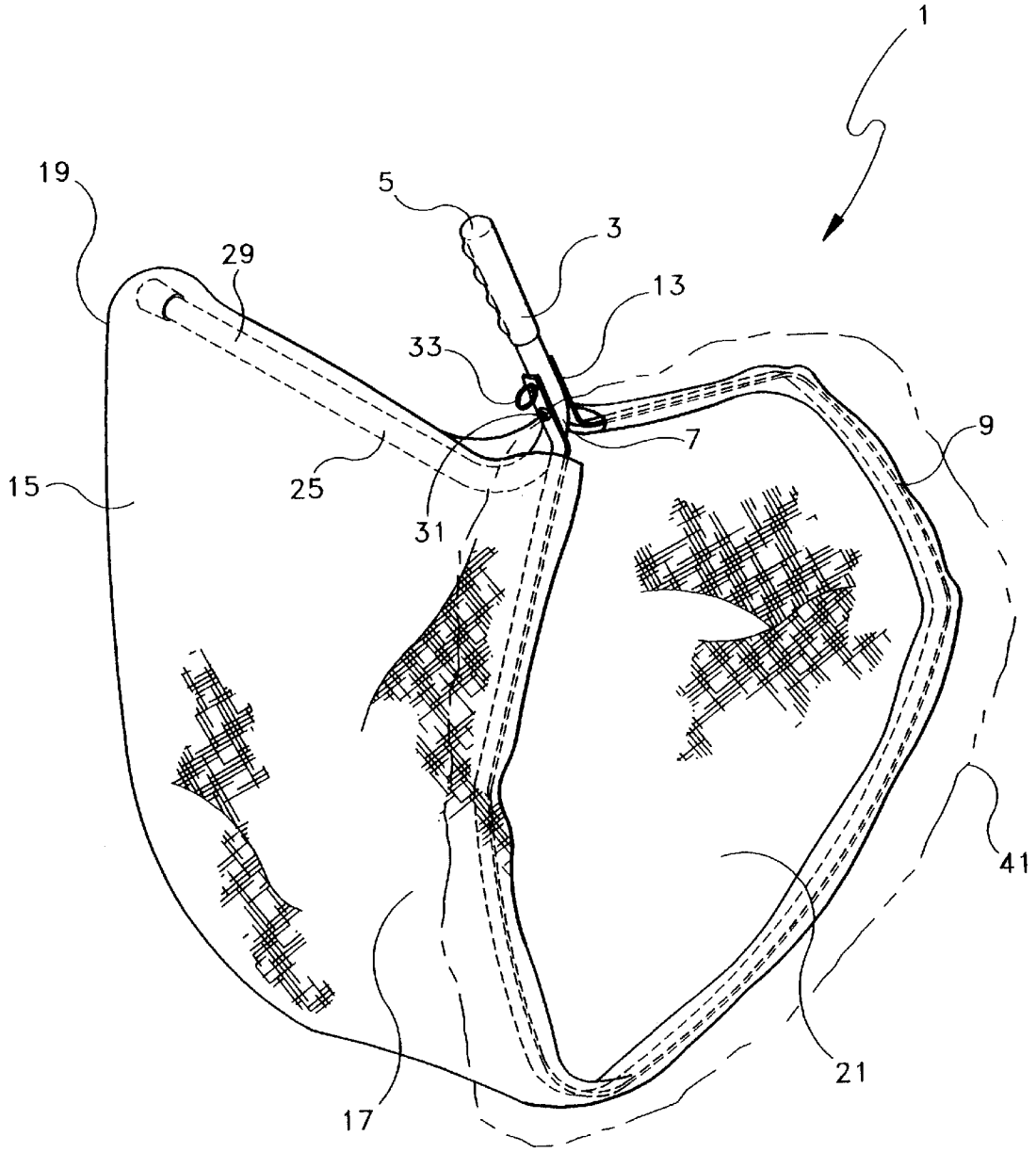
FIG. 1 is a perspective view of the device of this invention.

Turning now to the drawings where elements are identified by numerals and like elements are identified by like numerals throughout the four figures, FIG. 1 shows the overall view of the preferred embodiment of this invention 1 to comprise a straight handle 3 with grip having spaced-apart distal ends 5 and 7, respectively, for carrying in one's hand at an angle to the ground where the rear distal end 5 of said handle is carried above the front distal end 7.

A closed loop 9 depends from handle 3, said loop 9 being of metal or other material strong enough to retain the loop shape throughout its use in device 1. It is preferred that loop 9 be flattened along its bottom as shown in FIG. 1. For lightness and durability it is preferred that loop 9 be made of a light metal such as aluminum. For ease in fabrication, it is preferred that loop 9 be made of a strap of aluminum such as having wide, spaced-apart side walls and narrower, spaced-apart end walls as shown in the figures. As shown in FIG. 1, loop 9 terminates in two distal ends that form flattened end portions 13 spaced apart on each side of handle 3.

A flexible bag 15 is provided comprising integral bag sides 17, a closed bottom 19 and an open bag top 21, said top defined by a circumference that is peripherally mounted about loop 9, such as by stitching, so that bag 15 extends downward and rearward of said loop. Bag 15 is preferably made of a strong yet flexible material such as polypropylene or other suitable fabric.

A bag support 25, including a support arm 29, is provided and extends from handle front distal end 7 downwardly and rearwardly into bag 15 for holding loop 9 and bag 15 above the ground when said device is carried by handle 3. One of the unique features of this invention is that arm 29 extends inside bag 15 and, because it is maintained at an acute angle with handle 3, supports bag 15 at the top thereof and above the ground or other surface over which device 1 is carried.

It is preferred that handle 3 be integral with support arm 29. This construction insures that the angle "α" handle 3 makes with arm 29 remains fixed and arm 29 supports bag 15 even when said bag is heavily laden with trash. It is even further preferred that handle 3 and arm 29 be fixed at an angle to each other less than 90°, such as 45°, as shown in FIG. 2.

Figure 2:
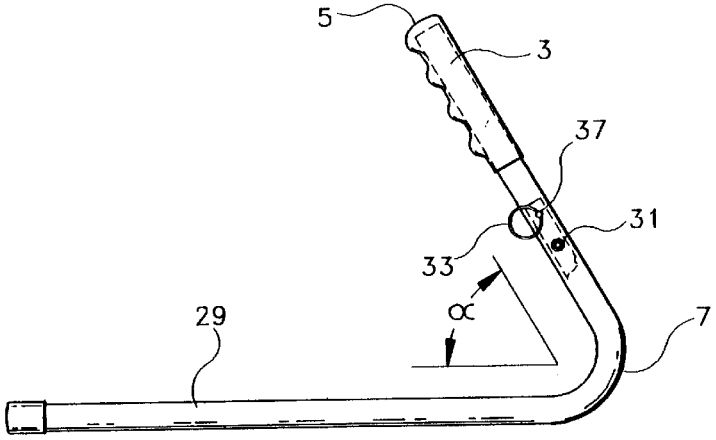
FIG. 2 is a close-up view of the handle and support arm used in the embodiment shown in FIG. 1.
Figure 3:
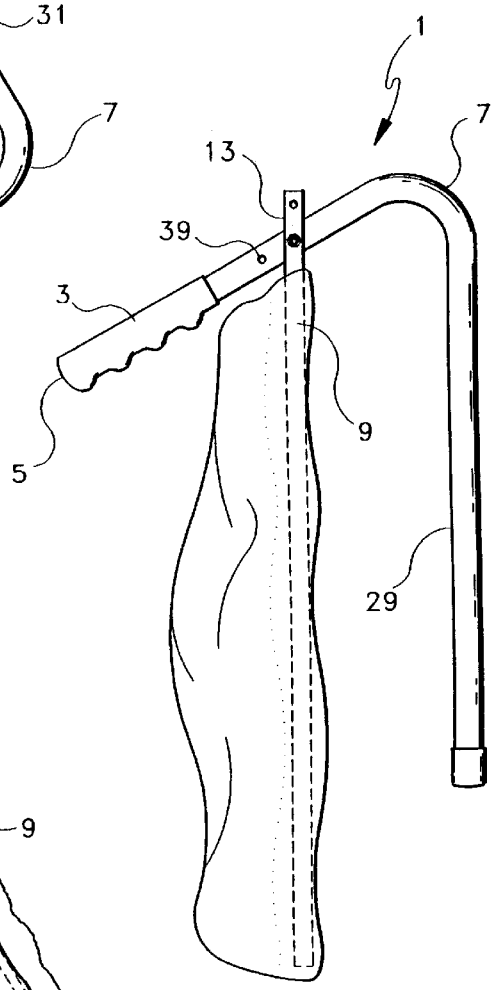
FIG. 3 is a side illustrative view of the embodiment shown in FIG. 1 that has been folded up for storage; and, FIG. 4 is another embodiment of the invention.

As shown in FIG. 2, a preferred manner of connecting loop 9 to handle 3 is to attach it pivotally with a bolt 31 and then lock the position of loop 9 vis-a-vis handle 3 by an unlockable lock 33. A preferred form of unlockable lock 33 comprises a removable pin and ring 37 slidingly mounted in an aperture 39 formed transversely through the forward end of handle 3 and loop 9 that become matched when loop 9 is rotated into the appropriate configuration with handle 3 as shown in FIG. 1. In this configuration, removal of pin 37 allows loop 9 to be folded toward handle 3, as shown in FIG. 3, so that device 1 can be hung up against a wall on a peg for storage.

The size and shape of bag 15 is preferably set to the size of a typical 33-gallon plastic garbage bag 41 as shown in FIG. 1. Bag 41 may be slipped into bag 15, over support arm 29, and the circumferential opening at the top folded out over loop 9 as shown in FIG. 1. In this embodiment, support arm 29 now holds both bag 15 and bag 41 in the proper arrangement thus allowing trash to be stuffed into bag 41 for later bagging, removal (from device 1) and storage of bag 41 awaiting disposal. The strength of bag 15 provides substantial support to plastic bag 41 so that much more trash can be stuffed into bag 41, without ripping or tearing the walls of bag 41, than could be placed therein without the support of bag 15.

Figure 4:
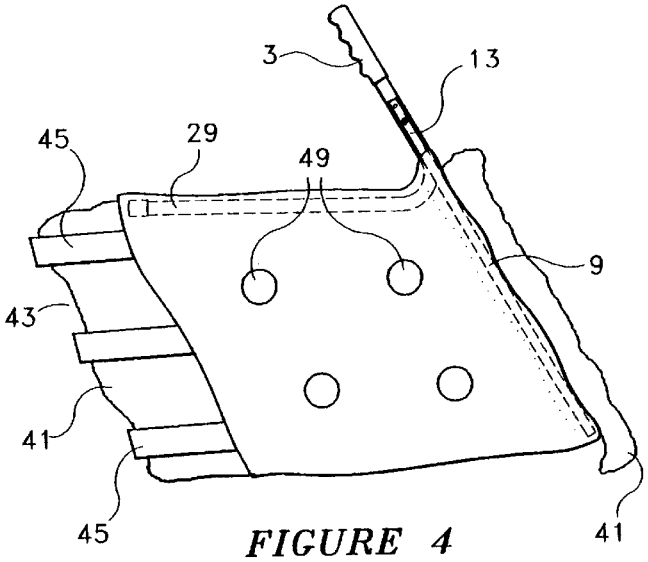

If the device is to be always used with a typical 33-gallon plastic garbage bag 41, bag 15 may be modified, as shown in FIG. 4, to have an open bottom 43 with cross-straps 45, and/or apertures 49 formed in the sides thereof, or other construction where bag 15 could not itself hold trash but could support trash bag 41 in such a manner that trash could be stuffed into bag 41 and support bag 41 while this was occurring.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. A portable trash carrying device comprising:

a) a closed loop;

b) a flexible bag comprising integral bag sides, a closed bottom and an open bag top, said top peripherally mounted about said loop so that said bag extends rearward of said loop; and, c) a bag support comprising a carrying handle to hold said loop, and an arm extending rearward from said handle at an acute angle therewith and into said bag to hold said bag above the ground during use.

2. The portable trash carrying device of claim 1 wherein said loop is in the form of a flattened strap joined to both sides of said handle.

3. The portable trash carrying device of claim 1 wherein said loop is flattened along the bottom thereof.

4. The portable trash carrying device of claim 1 wherein said handle is integral with said arm.

5. The portable trash carrying device of claim 1 wherein said handle and said arm are fixed at an angle to each other less than 90°.

6. The portable trash carrying device of claim 1 wherein said handle and said arm are fixed at an angle to each other of 45°.

7. The portable trash carrying device of claim 1 wherein said handle is pivotally mounted to said loop and moveable into non-pivotal operative position by insertion of a separate unlockable lock.

8. The portable trash carrying device of claim 7 wherein said unlockable lock comprises a removable pin for insertion into an aperture formed transversely through said handle and said loop that become matched when said loop is rotated into the appropriate operative configuration with said handle.

9. The portable trash carrying device of claim 1 wherein said arm and said handle are moveable to allow said loop to be collapsed into a storage configuration with said loop.

10. The portable trash carrying device of claim 1 wherein said bag is sized to accept a 33-gallon plastic trash bag that may be temporarily attached about said loop, filled with matter, and later removed therefrom when to store the contents contained therein.

11. The portable trash carrying device of claim 1 wherein said bag has formed therein an open bottom with straps thereacross said bottom to support another trash bag temporarily housed therein.

12. The portable trash carrying device of claim 1 wherein said bag has apertures formed therein.

13. A portable trash container comprising:

a) a handle for carrying said container above the ground having spaced-apart distal ends for carrying in one's hand at an angle to the ground where the rear distal end of said handle is carried above the front distal end;

b) a closed loop depending from said handle;

c) a support arm integral with said handle and extending at an acute angle with said handle and rearwardly therefrom above the ground; and, d) a flexible bag comprising integral bag sides and an open bag top, said top peripherally mounted about said loop so that said bag extends rearward of said loop and about said support arm to be retained above the ground during use.

14. The portable trash carrying device of claim 13 wherein said loop is in the form of a flattened strap joined to both sides of said handle.

15. The portable trash carrying device of claim 13 wherein said handle and said arm are fixed at an angle to each other less than 90°.

16. The portable trash carrying device of claim 13 wherein said handle and said arm are fixed at an angle to each other of 45°.

17. The portable trash carrying device of claim 13 wherein said handle is pivotally mounted to said loop and moveable into non-pivotal operative position by insertion of a separate unlockable lock.

18. The portable trash carrying device of claim 17 wherein said unlockable lock comprises a removable pin for insertion into an aperture formed transversely through said handle and said loop that become matched when said loop is rotated into the appropriate operative configuration with said handle.

19. The portable trash carrying device of claim 13 wherein said arm and said handle are moveable to allow said loop to be collapsed into a storage configuration with said loop.

20. The portable trash carrying device of claim 13 wherein said bag is sized to accept a 33-gallon plastic trash bag that may be temporarily attached about said loop, filled with matter, and later removed therefrom when to store the contents contained therein.

* * * * *